United States Patent [19]

Ohya

[11] Patent Number: 4,465,122

[45] Date of Patent: Aug. 14, 1984

[54] METHOD FOR REDUCING MOLD WIDTH DURING CONTINUOUS CASTING

[75] Inventor: Mutsumi Ohya, Fukuoka, Japan

[73] Assignee: Nippon Steel Corporation, Tokyo, Japan

[21] Appl. No.: 279,018

[22] Filed: Jun. 30, 1981

[30] Foreign Application Priority Data

Jul. 3, 1980 [JP] Japan ..... 55-91184

[51] Int. Cl.[3] ..... B22D 11/04; B22D 11/16

[52] U.S. Cl. ..... 164/491; 164/436

[58] Field of Search ..... 164/491, 436, 452

[56] References Cited

U.S. PATENT DOCUMENTS 4,134,441 1/1979 Ohmori et al. ..... 164/491

FOREIGN PATENT DOCUMENTS 50-152926 12/1975 Japan ..... 164/491

51-14825 2/1976 Japan ..... 164/436

53-1131 1/1978 Japan ..... 164/436

*Primary Examiner*—Kuang Y. Lin

*Assistant Examiner*—J. Reed Batten, Jr.

*Attorney, Agent, or Firm*—Cushman, Darby & Cushman

[57] ABSTRACT

In a mold having a pair of narrow side walls, a method for reducing the mold width during continuous casting of molten metal includes, as a first step, inwardly moving the upper end portion of at least one of the narrow side walls while maintaining the lower end of that side wall fixed. Thereafter, as a second step, the whole narrow side wall is uniformly moved so that the lower and upper end portions move in parallel. Then, as a third step, the lower end portion of the narrow side wall is moved inwardly until the side wall is inclined at a predetermined angle, thus completing the mold width reduction.

1 Claim, 10 Drawing Figures

METHOD FOR REDUCING MOLD WIDTH DURING CONTINUOUS CASTING

BACKGROUND OF THE INVENTION

1. Field of the Invention

The present invention relates to a method for changing, particularly reducing the mold width during continuous casting of molten metal in particular.

2. Description of the Prior Arts

Conventional methods for reducing the mold width during continuous casting have generally been that both the upper and lower ends are moved simultaneously and at the same speed, in other words, the wall face of the mold is moved while being maintained to be parallel to the solid shell of the molten slab in the mold before the width changing.

The conventional methods have the following disadvantages and defects.

According to the conventional methods, when the moving speed of the mold wall is increased the deformation resistance of the solid shell of the molten slab also increases. Therefore, in order to perform the mold width reduction stably and consistently, it would be necessary to provide a width changing device having a pushing force larger than the above deformation resistance of the solid shell of the molten slab, hence the maximum mold wall movement is necessarily determined by the capacity of the width changing device, and the actual mold wall movement speed cannot exceed this maximum mold wall movement speed.

Also according to the conventional methods, the width reduction is performed by depressing and deforming the solid shell of the slab by the inside wall surface of the mold so that the inside wall surface is subjected to increase wear and resultant slabs are more susceptible to crackings to be caused in the same direction of the oscillation marks on the shorter sides of the slabs.

The conventional methods are illustrated in FIGS. 1*a*, 1*b* and 1*c*, in which the deformation amount of the solid shell of the slab caused by the movement of the inside wall of the mold is expressed as $\Delta W = ut$, and the maximum deformation amount is expressed by $\Delta W_{max} = uL/v$.

For illustration, examples are shown as below:

| L | v | u | Calculated $\Delta W_{max}$ |
|---|---|---|---|
| 800 mm | 600 mm/min. | 4 mm/min | 5.3 mm |
| | | 2 mm/min | 2.7 mm |

In FIGS. 1*a*, 1*b* and 1*c* 1 represents a mold wall, 2 represents a solid shell of the slab and 3 represents molten steel in the mold. u represents the mold width changing speed, namely the mold wall moving speed, v represents the casting speed, L represents the effective length of the mold and t represents the time after the commencement of the width changing.

Another conventional method as disclosed in Japanese Patent Application Laid-Open No. Sho 50-152926 comprises the following steps for performing the mold width reduction from a preceding mold width to a subsequent mold width during continuous casting.

(1) The upper end portion of the narrow side wall of the mold is inwardly moved in proportion to the slab drawing speed so as to reduce the width of the upper surface of the molten steel in the mold.

(2) The upper end portion of the narrow side wall is further moved until a desired width of the upper surface of the molten steel in the mold can be obtained.

(3) During the movement of the upper end portion, the lower end portion of the narrow side wall is pressed against the slab, and moves inwardly and gradually as the slab is reduced in width.

(4) Then the upper end portion of the narrow side wall of the mold is maintained so as to obtain a constant width of the upper surface of the molten steel in the mold, and while the lower end portion is pressed, the slab is drawn and the narrow side wall is maintained at the new position to complete the width change of the mold.

As understood from the sequential steps of the above conventional method, only the upper end portion of the narrow side wall of the mold is positively moved toward the center of the mold until a desired dimension of the upper surface of the molten steel can be obtained, while the lower end portion is pressed with an appropriate force against the slab, and is gradually and inwardly moved as the slab is reduced in width. Thus, the process of the conventional method is repetition of the pattern that the lower end portion of the narrow side wall of the mold is passively moved in pursuance of the changes in the slab width caused by the movement of the upper end portion of the narrow side wall, and after the upper end portion of the mold has reached a desired dimension, the upper end portion of the narrow side wall is maintained there and only the lower end portion of the narrow side wall is positively moved toward the center of the mold to complete the width changing (reduction). This is clearly different from the changing pattern of the mold cross section.

Further, according to the above conventional method, the lower end portion of the narrow side wall is pressed by appropriate force all the time during the width changing operation so as to follow up the changes in the upper surface of the molten steel, but this method cannot be said as a practically satisfactory process in view of the forming condition of the solid shell of the molten slab during continuous casting, and is very likely to be susceptible to operational difficulties such as break-out.

SUMMARY OF THE INVENTION

The object of the present invention is to provide a method for reducing the mold width during continuous casting, which method can eliminate the disadvantages and defects of the conventional arts as described hereinbefore, and enables a rapid mold width changing during high-speed continuous casting, thus assuring a high productivity and a high consistent operation.

According to the present invention, at the intial stage of the mold width changing operation, only the upper end portion of a narrow side wall is moved and then the narrow side wall as a whole is moved at a constant width changing moving speed determined by the movement amount of the upper end portion and the casting speed so as to keep the inside surface of the narrow side wall of the mold in close contact with the solid shell of the slab, or to keep an appropriate space therebetween.

The feature of the present invention lies in that for the purpose of reducing the width of the mold during the continuous casting operation, the upper end portion of a narrow side wall of the mold is inwardly declined in a swinging manner with the lower end portion of the side wall being fixed, then the side wall as a whole is inwardly moved while maintaining the inclination angle, and then the lower end portion of the side wall is inwardly moved so as to form a predetermined taper of the side wall, and that during the movement of the side wall, the inside surface of the side wall is maintained to be closely in contact with the solid shell of the slab or an appropriate space is kept therebetween.

In the present invention, the term "a predetermined taper" used as above means a taper required for compensating the contraction of the volume of molten steel due to solidification, and in the case of ordinary mold lengths of about 900 mm, it is determined according to the standard set forth below.

$$\frac{l}{w} = 0.2 \sim 0.8\%$$

wherein l represents the distance between the upper end of the narrow side wall of the mold and the perpendicular line extending from the corresponding lower end of the side wall, and w represents the width of the slab extracted from the mold. Specifically, when the width of the slab is 1000 mm, l is 2.0 to 8.0 mm.

DETAILED DESCRIPTION OF THE INVENTION

The present invention will be described in more detail by referring to FIGS. 2 to 6.

Figure 1A:
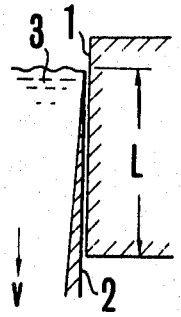
FIG.1(a) (PRIOR ART)
FIGS. 1(*a*), 1(*b*) and 1(*c*) show a conventional mold width changing method.
Figure 1B:
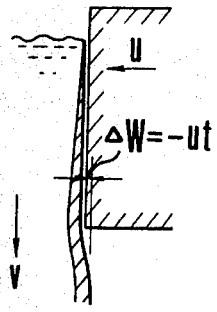
FIG.1(b) (PRIOR ART)
Figure 1C:
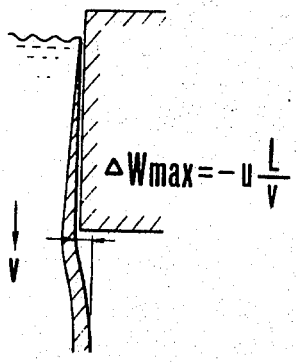
FIG.1(c) (PRIOR ART)
Figure 2:
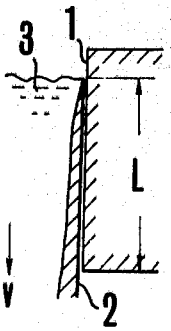
FIG. 2 schematically show the method according to the present invention, and particularly shows the state before the width reducing operation.

In FIG. 2, the state of the mold before the width reduction is illustrated, in which the inside surface of the narrow side wall 1 of the mold is kept in close contact with the solid shell 2 of the molten steel 3 in the mold. L represents the effective length of the mold and v represents the casting speed.

Figure 3:
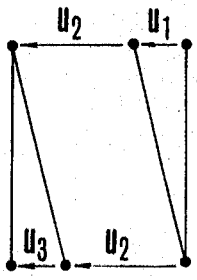
FIG. 3 is a graph illustrating the width reduction steps according to the present invention.

The method for reducing the mold width according to the present invention is illustrated in FIG. 3. In this embodiment, only the upper end portion of the narrow side wall of the mold is moved at the moving speed $u_1$ at the initial stage of the width reduction operation, and then both the upper and lower end portions are simultaneously moved in parallel to a predetermined position at speed $u_2$ for the width reduction, and then the lower end portion is moved at the moving speed $u_3$ to a predetermined position.

Suppose that the spaces between the inside surface of the narrow side wall of the mold and the corresponding solid shell of the molten steel at the time of the mold movement at different speeds $u_1$, $u_2$ and $u_3$ are respectively $\Delta W_1$, $\Delta W_2$, and $\Delta W_3$, and then the $\Delta W_1$ becomes maximum in the middle of the mold length, and this maximum value $\Delta W_{max}{}^1$ may be expressed below:

$$\Delta W_{1max} = -\frac{1}{4}\ \frac{u_1}{v}\ L \text{ (in the depressing condition)}$$

(L=effective length of the mold)

This maximum value is one fourth ($\frac{1}{4}$) of the $\Delta W_{max}$ according to the conventional arts.

Figure 4:
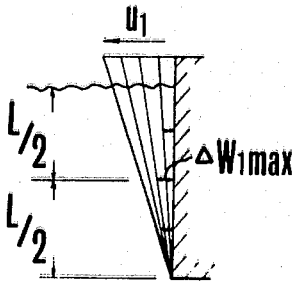
FIGS. 4, 5(*a*), 5(*b*), 5(*c*) and 6 schematically show the principle in the individual steps during the width reduction operation according to the present invention.

Further, as the lower end portion of the side wall is kept in close contact with the solid shell, it is possible to increase the speed $u_1$ and the casting speed v. In this case, the values $u_1$ and v can be maintained high by restricting the $\Delta W_{1max}$ value less than a certain predetermined value. This is shown in FIG. 4.

Figure 5A:
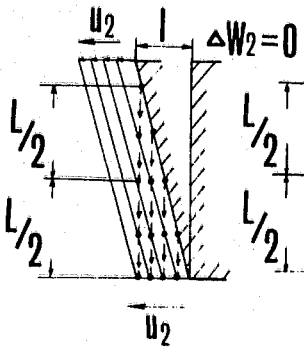

Now referring to FIG. 5*a*, when the changing speed $u_2$ is so maintained to satisfy the condition of $u_2 = l/Lv$ (l represents the movement distance at the speed $u_1$), $\Delta W_2$ can be maintained at zero ($\Delta W_2 = 0$).

Thus it is possible to maintain the inside surface of the narrow side wall in close contact with the solid shell all the time. In this case, a higher casting speed permits a higher mold width changing speed, and when the constant K is introduced to the formula of $u_2 = l/Lv$ and the constant K is maintained to be larger than 1.0 or smaller than 1.0 ($K < 1.0$ or $K > 1.0$), it is possible to reduce the mold width with the space being provided between the mold wall and the solid shell or with the solid shell being depressed by the mold wall.

According to the present invention as described hereinbefore, during the second step of inward parallel movement of the side wall as a whole, the inside surface of the side wall is kept in close contact with the solid shell of the slab or an appropriate space is kept therebetween.

More detailed description will be made hereinbelow on this point.

Figure 5B:
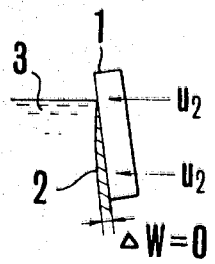
Figure 5C:
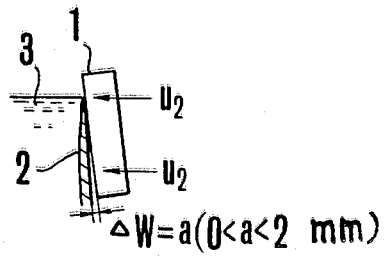

FIG. 5(*b*) shows the case where the inside wall is kept in close contact with the shell and FIG. 5(*c*) shows the case where an appropriate space is kept therebetween.

In FIG. 5(*b*), no space is formed thus $\Delta W = 0$, the side wall as a whole moves inwardly with the whole of the inside surface of the side wall being kept in close contact with the solid shell surface so that a good shape quality of the slab can be obtained and there is practically no danger of break-out, although there is a small tendency of wearing of the mold surface due to the close contact. On the other hand, in FIG. 5(*c*), the space a is kept at the lower end of the narrow side wall between the solid shell and the mold surface during the parallel movement of the side wall. In this case, bulging of the slab occurs sometime under the condition of $\Delta W = a$(O21 $a < 2$ mm) but there is no practical problem of the upper limit if bulging is maintained within the range which is free from danger of break-out, for example, not more than 5 mm of bulging. Also as compared with the case shown in FIG. 5(*b*), the tendency of wearing of the mold surface becomes much less.

During the third step if the width changing speed $u_3$ is equal to $u_1$($u_3 = u_1$), the space $\Delta W_3$ can be expressed as below:

$$\Delta W_3 = \Delta W_1 = \frac{1}{4}\ \frac{u_1}{v}\ L$$

Figure 6:
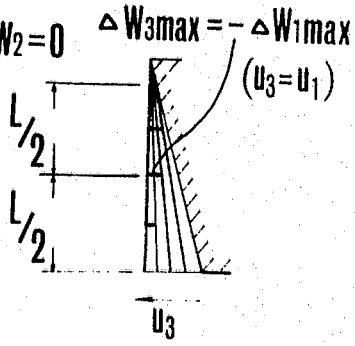

Thus the space is maintained between the solid shell and the inside wall of the narrow side of the mold. This is illustrated in FIG. 6.

The examples of the present invention as applied to the mold width reduction by 30 mm only from one side of the mold are shown below in comparison with the conventional method.

| | L (mm) | v (mm/min) | u (mm/min) ul | u (mm/min) Moving Speed | l (mm) | $\Delta W_{max}$(mm) ΔWi | $\Delta W_{max}$(mm) Calculated Value | Condition |
|---|---|---|---|---|---|---|---|---|
| A Present Invention | 800 | 1200 | $u_1$ | 10 | 6.7 | $\Delta W_{1max}$ | −1.67 | Depressed |
| | | | $u_2$ | 10 | | $\Delta W_{2max}$ | 0 | with |
| | | | $u_3$ | 10 | | $\Delta W_{3max}$ | +1.67 | Space |
| B Conventional Method | 800 | 1200 | $u_2$ | 10 | 0 no change in taper | $\Delta W_{2max}$ | 0 due to depressed deformation | Depressed |

| | Amount of Width Reduction | Required Time | Total Required Time | Affected Length of Slab by Width Change | Required Depressing Force | Remarks |
|---|---|---|---|---|---|---|
| A Present Invention | 30 mm (in one side) | 0.7 min 3.0 min 0.7 min | 4.4 min | 5.3 m (4.4 min × 1.2 m/min) | 4000 kg | — |
| B Conventional Method | 30 mm | 3.0 min | 3.0 min | 3.6 m (3.0 min × 1.2 m/min) | 7400 kg (all through the width changing operation) | width change is done while the slab is being depressed and deformed |

As understood from the foregoing description of the present invention, the present invention has the following advantages over the conventional art.

Due to the fact a small depressing force is enough, the device required for changing the width of the mold may be of small depressing capacity, thus reducing the capital cost. Increased depressing force is required only when the moving speed of the mold is increased or when the thickness of the solid shell increases (lowering of the casting speed).

Contrary to the conventional art where the molten slab is continuously depressed and deformed, the wearing of the inside walls of the mold is remarkably reduced, thus lowering the running cost.

Further, there is no danger of slab surface defects due to cracking in the same direction of oscillation marks caused by the depression deformation, thus improving the slab quality.

The forgoing description and embodiments have been made chiefly for the case where the width reduction is performed by moving one of the pair of narrow side walls of the mold, but it should be understood that both of the pair of narrow side walls may be simultaneously or alternately moved.

What is claimed is:

1. A method for reducing a mold width during continuous casting of molten metal, which comprises:

a first step of inwardly moving the upper end portion of at least one of pair of narrow side walls of the mold while the lower end of said narrow side wall is fixed;

a second step of inwardly moving the narrow side wall as a whole to cause the lower and upper end portions to move in parallel, and wherein said second moving step is performed under the condition of $$u_2 = K \cdot \frac{l}{L} v$$

wherein $u_2$ represents the moving speed of the side wall in the second step, l represents the movement distance of the upper end portion in the first step, v represents the casting speed, K is a constant less than 1.0, equal to 1.0, or larger than 1.0, and L represents the effective length of the mold; and a third step of further inwardly moving the lower end portion of the narrow side wall so as to incline the narrow wall in a predetermined angle to complete the mold width reduction.

* * * * *